US009366491B1

(12) United States Patent
Baxley

(10) Patent No.: US 9,366,491 B1
(45) Date of Patent: Jun. 14, 2016

(54) BRASS CATCHING DEVICE

(71) Applicant: Steven Baxley, Jacksonville, FL (US)

(72) Inventor: Steven Baxley, Jacksonville, FL (US)

( * ) Notice: Subject to any disclaimer, the term of this patent is extended or adjusted under 35 U.S.C. 154(b) by 0 days.

(21) Appl. No.: 15/051,146

(22) Filed: Feb. 23, 2016

(51) Int. Cl.
*F41A 9/60* (2006.01)
*F41A 23/02* (2006.01)

(52) U.S. Cl.
CPC .. *F41A 9/60* (2013.01); *F41A 23/02* (2013.01)

(58) Field of Classification Search
USPC ..... 42/94, 98; 89/33.4; 211/64
See application file for complete search history.

(56) References Cited

U.S. PATENT DOCUMENTS 4,296,565 A * 10/1981 Jaffin ..... F41A 9/60 232/1 R
6,354,035 B1 * 3/2002 Niebuhr ..... F41A 9/60 42/98
2003/0221355 A1 * 12/2003 Castaldo ..... F41J 11/00 42/98
2014/0196350 A1 * 7/2014 Wiese ..... F41A 23/14 42/94
2015/0316338 A1 * 11/2015 Rosenthal ..... F41A 9/60 42/98

* cited by examiner

*Primary Examiner* — J. Woodrow Eldred
(74) *Attorney, Agent, or Firm* — Lawrence J. Gibney, Jr.

(57) ABSTRACT

This device will catch and capture expended brass casings as they are ejected out of a weapon during shooting practice at a target range. This will save money in terms of allowing the individual to repack their casings and also prevent a littering problem from a multitude of brass casings, which have been ejected from weapons that are found on shooting ranges.

8 Claims, 5 Drawing Sheets

BRASS CATCHING DEVICE

REFERENCE TO OTHER APPLICATION

The applicant is filing a continuation in part which seeks priority from non-provisional application Ser. No. 14/702,928 that was filed on May 4, 2015.

BACKGROUND OF THE INVENTION

A. Field of the Invention

Many individuals participate in the recreational activity of shooting guns at a shooting range. Many different types of guns are used but all guns fire a projectile that has a casing. Some common guns use brass casings and as the gun is fired the casing is ejected from the gun to make room for the next bullet. Many enthusiasts repack their casings to save money.

This device allows an individual to easily retrieve the casings so that the casing can be reused. Additionally the structure allows a person to rest his or her arm on the device.

B. Prior Art

There are prior art references to brass catching devices that are found in the prior art and a representative example of this is Niebuhr U.S. Pat. No. 6,354,035. This device has a bottom structure as well as an elongated middle structure. Within the middle structure a net is provided to catch the brass casings as they are ejected from the weapon. The top portion can be removed from the bottom for storage. This reference does not provide an arm rest for the shooter nor does it provide a double net dampening system.

Another example that is found in the prior art is Jaffin U.S. Pat. No. 4,296,565 which is an apparatus for collecting ejecting cartridges which is substantially different from the device in the current application.

Other examples in the prior art include Riddle U.S. Pat. No. 5,138,787 and Lalor US Patent Publication 2013/0192450. Neither of these references are similar to the current application.

BRIEF SUMMARY OF THE INVENTION

This is a device by which a gun owner, particularly one that goes to a shooting range, can retrieve expended brass casings. This retrieval is needed so that the user can reload the casings to save money and also leave the area around the shooter clean. It is not uncommon to fire over one hundred practice rounds when attending a shooting range for practice. It is also not uncommon for the enthusiast to go to a shooting range on a weekly basis.

The device has a bottom structure and an upright structure. A hard bottom surface will be provided. Above one end of the hard bottom surface a netting or mesh will be provided. As the casing is ejected the casing would be entrapped by the mesh and fall to the hard bottom structure.

A pair of wires will support the net or mesh. A wooden dowel on one end will provide the framework for the structure to catch the casing. The netting or mesh structure may be collapsible. The upright structure will be a predetermined height and structure. The shape of the mesh structure may vary depending on the type of weapon involved.

On one end of the hard bottom structure a rest for the gun owner's arm will be provided. Between the arm rest and the cavity for the gun casing will be a straight edge to rest a rifle.

With this device the brass casing is easily retrieved for future use.

There are many positions that can be used at the shooting range. A stand that telescopes and locks into position onto which the device can be mounted to allow a person to fire while standing may also be provided.

The device may be used by the person who shoots right handed as well as the person who shoots left-handed. When not in use the device can also be used to store common devices that are used at the shooting range: eye protection and ear protection.

As the gun is fired and the casing is ejected it strikes the netting and ricochets downward into the cavity below the netting material. The shell will then fall to the bottom portion of the structure under the netting. An opening on the bottom will allow the user to simply tilt the device to retrieve the brass shell casings.

NUMBERING DESCRIPTION

Figure 1:
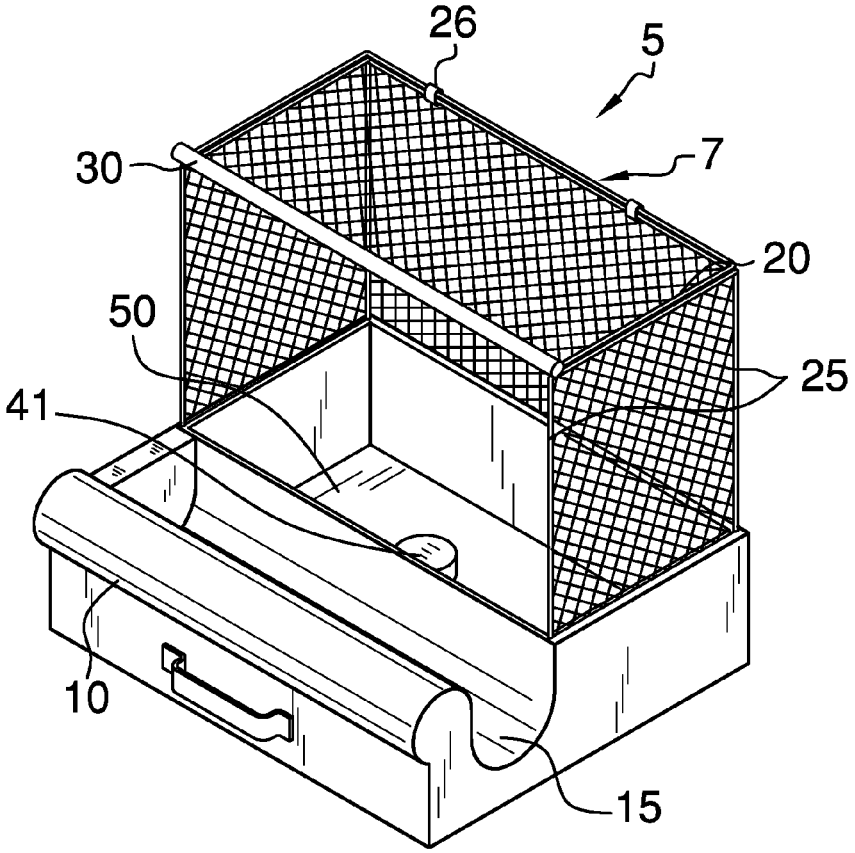
FIG. 1 is an isometric view of the device.

5 Device
7 Netting Structure
10 Arm Rest
15 Groove for resting a rifle
20 Mesh
25 Semi-Rigid Posts
26 Connector
27 Hinge
30 Dowel
35 Base
40 Stand
41 Cavity
45 Locking pin
46 Locking Pin Hole
50 Box

DETAILED DESCRIPTION OF THE EMBODIMENTS

This device 5 will be used to capture expended brass casings as they are ejected from weapons on a shooting range. On this device 5 there will be a box 50 that has a predetermined size with an attached netting structure 7. The netting structure 7 is collapsible and is comprised of mesh 20, a plurality of semi-rigid posts 25, a wooden dowel 30, connectors 26, and a hinge 27. The netting structure 7 is further comprised of four rectangular panels: a top panel, first side panel, second side panel, and a back panel. The two semi-rigid posts 25 on the front of the netting structure will mate with two holes in the top of the box (depicted in FIG. 2) to maintain the shape of the netting during normal use such as depicted in FIG. 1.

Figure 2:
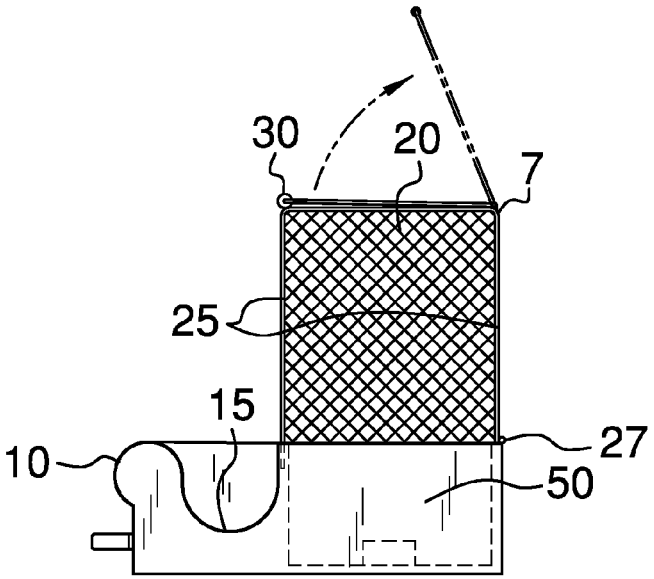
FIG. 2 is a right side view of the device.
Figure 3:
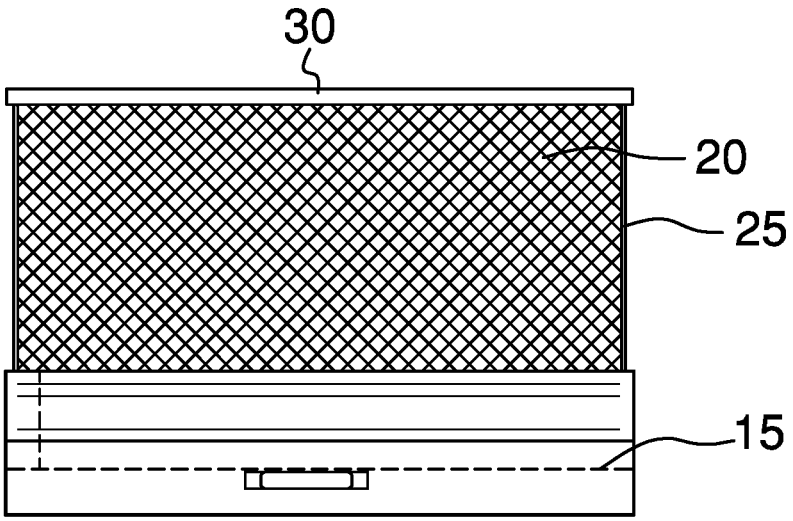
FIG. 3 is a front view of the device.

The top panel is attached to the first side panel, the second side panel, and the back panel with connectors 26 as depicted in FIG. 1. The back panel is then attached to the box 50 at the opposing side of which it is attached to the top panel. The back panel is attached to the box with a hinge 27. Each side panel is additionally attached to the box 50 with a dowel rod 30 and to the back panel with connectors 26 as shown in FIG.

2. The back panel is attached to the top panel, the first side panel, the second side panel, and the hinge 27, which is attached to the box 50.

Figure 5:
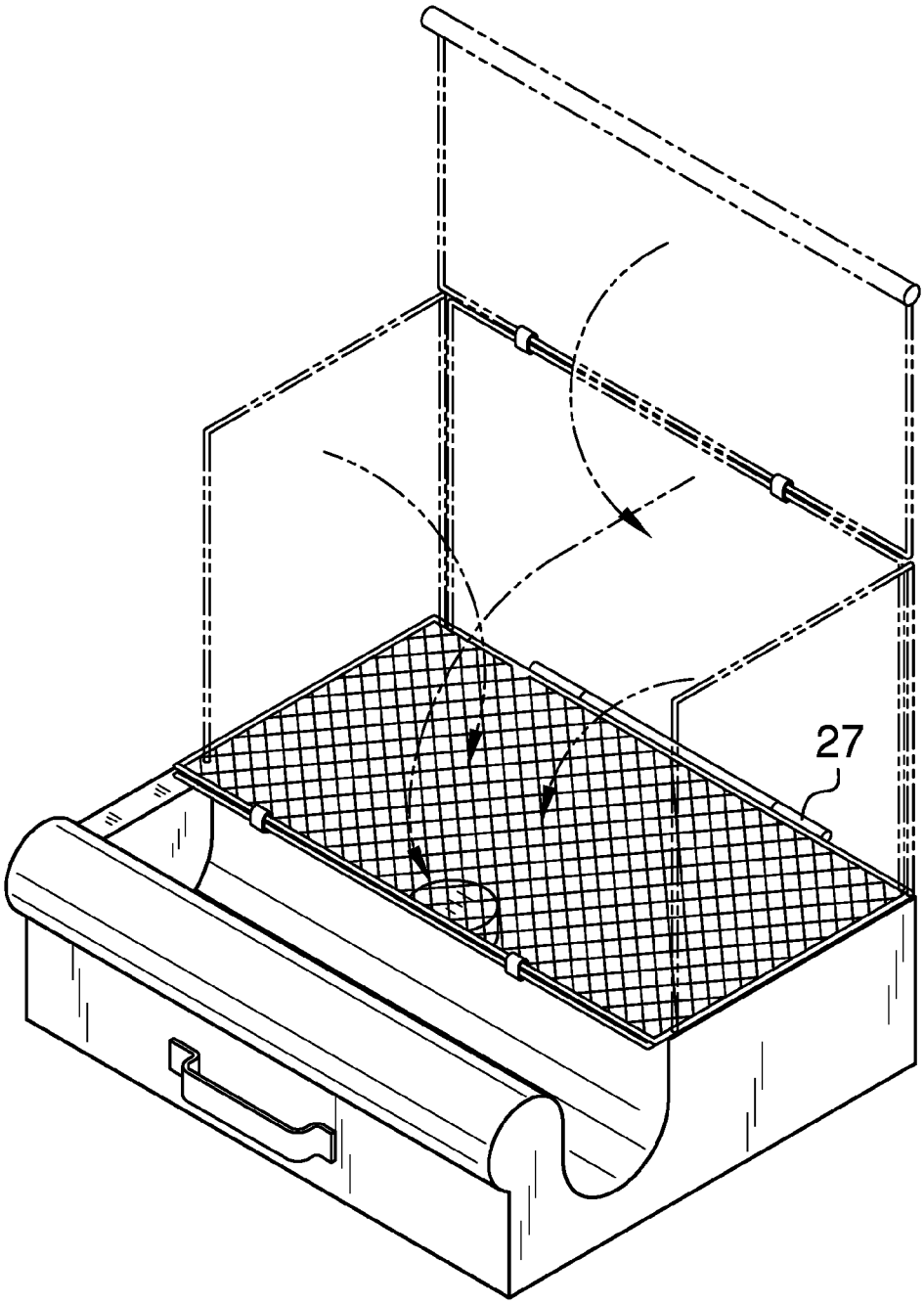
FIG. 5 is an isometric view of the device, which depicts how the netting is collapsed.

When the structure 7 collapses it lays flat and covers the entirety of the box as shown in FIG. 5 for easy storage and transport.

The netting structure is positioned as depicted FIG. 1 when it is in use has a netting structure that is positioned above the structure of the box 50. The purpose of the bottom surface in the box 50 is to ensure that the brass casing is caught after it is expended from the weapon.

It is contemplated that the device will be made from lightweight durable material that can be easily transported from location to location. The structure will have a first end and a second end. On the first end will be a bottom structure and on the second end will be a place to rest the shooter's arm.

The individual will place the weapon so that as the casing is ejected it will be projected towards the middle of the netting structure 7. The netting structure will be configured so that it will aid in the capture of the ejected casing without interfering with the operation of the gun or impede the sight of the gun owner.

An arm rest, 10, will be provided so that the person can lay his or her arm along the arm rest during target practice. Additionally, a groove 15 will be provided. The groove 15 will provide a first end and a second end. The first end of the groove will have a straight edge, which is important because it allows the barrel of the rifle to rest at a comfortable shooting position.

Once the person has completed his target practice all the brass casings will be collected in the bottom of the box 50. The person may then collapse the netting structure 7 and secure it to the box 50, thereby securing the casings inside the box, until the casings removal is desired. When the person wants to retrieve the casings, the gun owner can simply release the securing mechanism and flip the collapsed netting structure 7 so that the casings are accessible from the box 50 for refiling.

Figure 4:
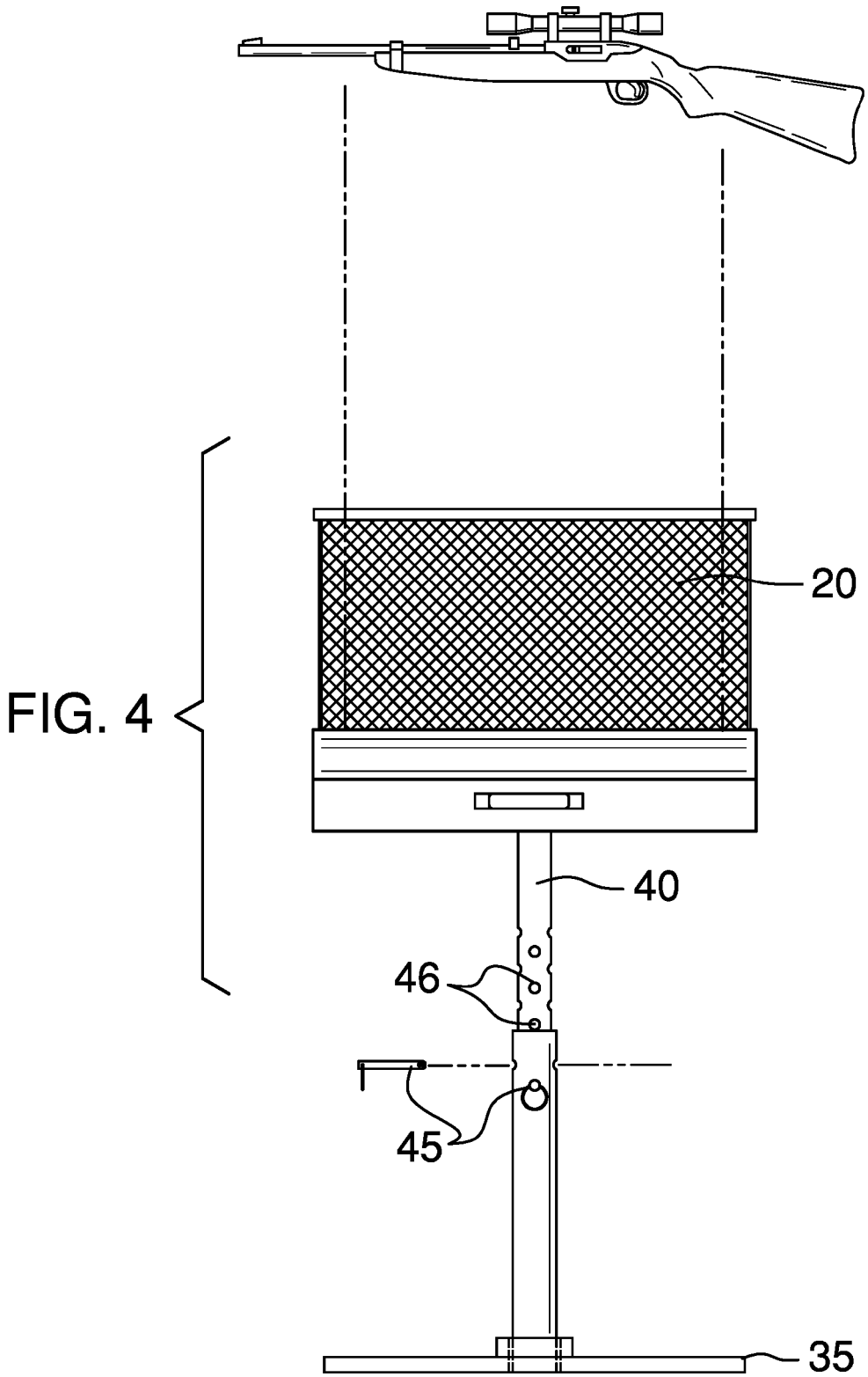
FIG. 4 is a view of the device on an adjustable stand.
Figure 6:
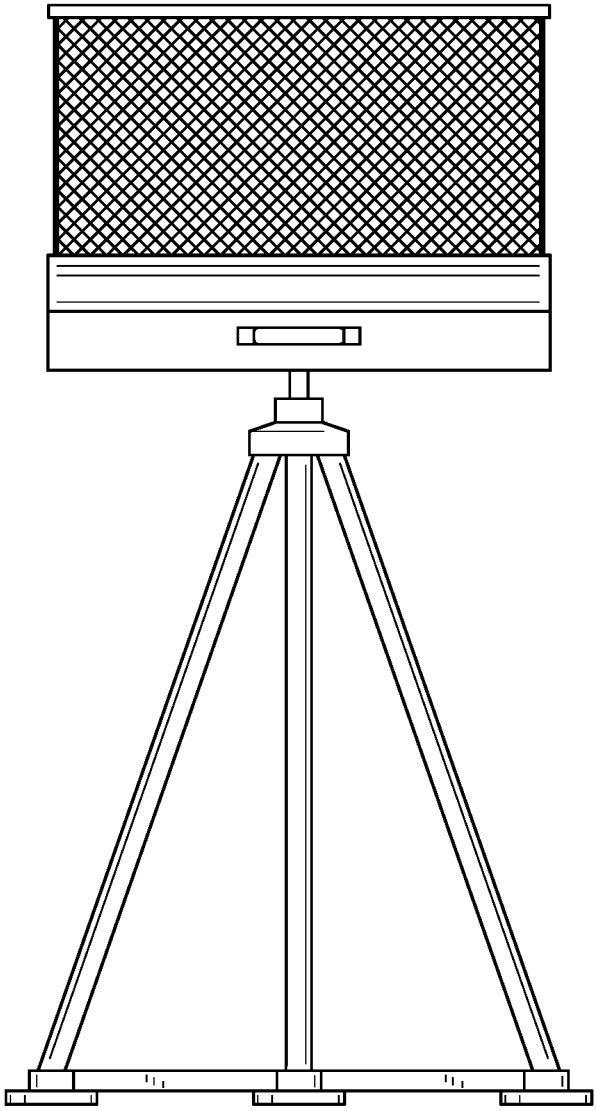
FIG. 6 is a front view of the device on a tripod strand.

In some circumstances a person may desire to shoot standing up. Accordingly, a stand 40 with a base 35 to mount the device is provided such as depicted in FIG. 4. The stand 40 can be secured (not depicted) at the bottom of the box; no particular means to secure the stand to the box is being claimed. FIG. 4 shows that the height of the stand is adjustable through a plurality of holes 46 for that purpose. It is contemplated that a locking pin 45 will be provided to adjust the height of the stand 40. A base 35 for the stand 40 is also provided to stabilize the device on the ground. The stand 40 may be as depicted in FIG. 4 or a tripod as depicted in FIG. 6. A cavity 41 within the box surface is provided to secure the stand to the device.

An alternative tripod stand is shown in FIG. 6. Although the stand shown is not adjustable, it is contemplated that an adjustable tripod stand could be used instead. The leg bracing may also be placed lower or higher depending on the shooter's preference and the shooter's surroundings.

The invention claimed is:

1. A brass catching device which is comprised of:
a. a structure;
wherein the structure has a predetermined shape;
wherein a box is provided on the structure;
wherein said box has a predetermined shape;
b. an armrest;
wherein the arm rest allows the individual to fire a weapon during shooting practice;
wherein the arm rest allows an individual to fire while lying down;
c. a groove;
wherein a groove is provided between the box and the armrest;
wherein the groove has a predetermined shape;
wherein the groove has an open end and a closed end;
wherein the groove has a straight edge on the closed end;
c. a netting structure;
wherein a netting structure is provided on a first end of the structure;
wherein the netting structure is secured to the box;
wherein the netting structure is removable;
said netting structure is comprised of a plurality of mesh panels;
said mesh panels are comprised of a plurality of wires;
wherein the netting structure is collapsible;
d. a plurality of dowels;
wherein the plurality of dowels give shape to the netting structure;
e. a stand;
wherein the stand allows the device to be elevated off the ground;
wherein the stand is connected to the bottom of the box;
wherein the height of the stand can be adjusted;
wherein a locking pin is provided;
said locking pin is inserted through a hole to fix the position of the stand;
wherein a base member on the bottom of the stand is provided.

2. The device as described in claim 1 wherein a plurality of holes is provided on the stand.

3. The device as described in claim 1 wherein the stand is a tripod.

4. The device as described in claim 1 wherein the mesh panels are connected to each other with connectors.

5. The device as described in claim 1 wherein the netting structure is comprised of four mesh panels: a top panel, a back panel, a first side panel, and a second side panel.

6. The device as described in claim 4 wherein the back panel attaches to the box with a hinge.

7. The device as described in claim 4 wherein the first side panel and second side panel are secured with one dowel rod that protrudes into the openings on the top of the box.

8. The device as described in claim 1 wherein a plurality of holes is provided on the stand.

* * * * *